US006863192B2

(12) United States Patent
Tumlinson

(10) Patent No.: US 6,863,192 B2
(45) Date of Patent: Mar. 8, 2005

(54) EXPANDABLE, COMBINATION DISPENSER AND DISPOSAL FOR TISSUES

(76) Inventor: Larry Neal Tumlinson, 417 Sierra Rd., Kerrville, TX (US) 78028

( * ) Notice: Subject to any disclaimer, the term of this patent is extended or adjusted under 35 U.S.C. 154(b) by 109 days.

(21) Appl. No.: 10/425,218

(22) Filed: Apr. 29, 2003

(65) Prior Publication Data

US 2003/0234257 A1 Dec. 25, 2003

Related U.S. Application Data

(60) Provisional application No. 60/376,071, filed on Apr. 29, 2002.

(51) Int. Cl.[7] ..... A47K 10/24
(52) U.S. Cl. ..... 221/45; 221/97
(58) Field of Search ..... 221/33, 45, 46, 221/58, 56, 63, 92, 97; 206/494, 499, 555, 812

(56) References Cited

U.S. PATENT DOCUMENTS 3,942,682 A * 3/1976 McKay ..... 221/58
6,283,295 B1 * 9/2001 Akutagawa et al. ..... 206/494

* cited by examiner

*Primary Examiner*—Kenneth Noland

(57) ABSTRACT

This invention is a facial tissue dispensing and disposing system which includes an expanding container having a dispensing opening on the top and a disposing opening on the bottom. A tissue clip is enclosed in flaccid plastic with a cardboard floor and adhered to the underside of the dispensing opening. The clip is elevated and the side walls are expanded by inserting used tissues in disposal openings in the bottom.

5 Claims, 2 Drawing Sheets

EXPANDABLE, COMBINATION DISPENSER AND DISPOSAL FOR TISSUES

CROSS-REFERENCED TO RELATED APPLICATIONS

U.S. application No. 60/376,071

Filing date Apr. 29, 2002

FEDERALLY SPONSORED RESEARCH

Not applicable

SEQUENCE LISTING OR PROGRAM

Not applicable

FIELD OF THE INVENTION

Figure 1:
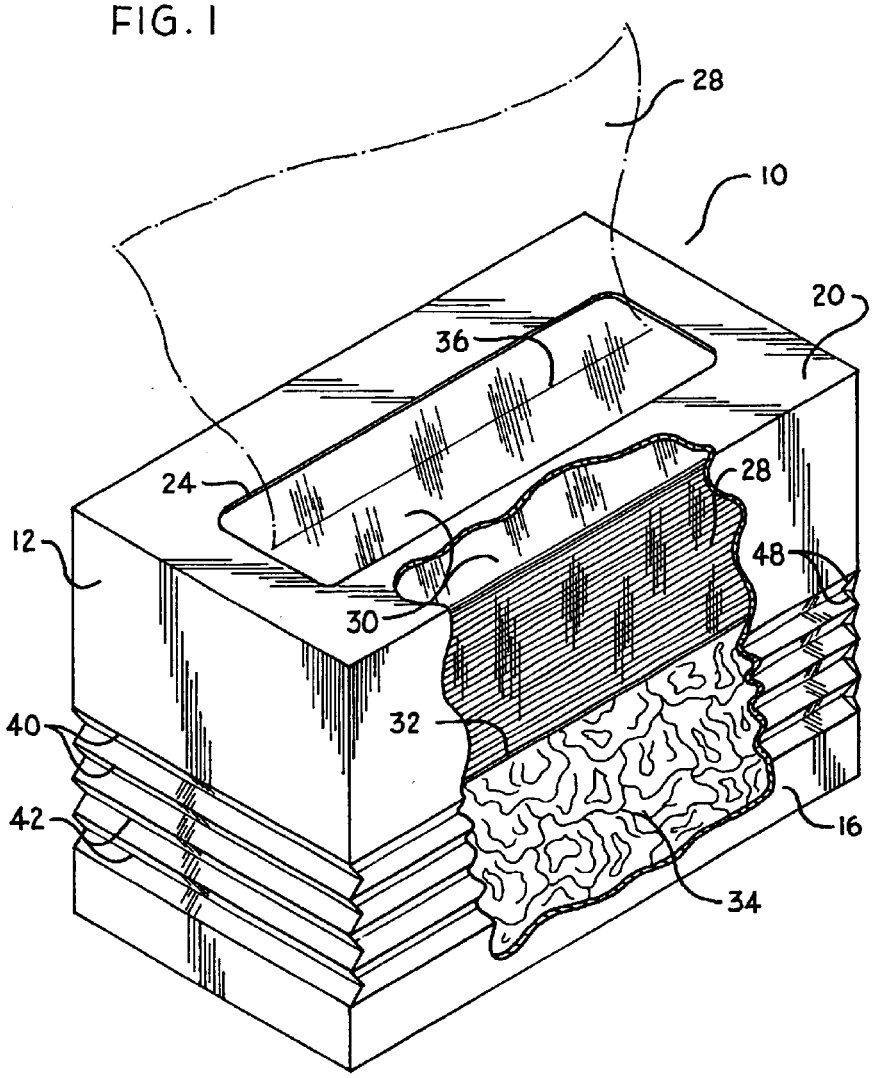

This invention relates to a system for dispensing facial tissues from within a plastic bag, attached inside an expandable carton, and sanitarily disposing of used tissues within the same carton.

BACKGROUND OF THE INVENTION

Facial tissues and their dispensing systems are well known in the art. Presently, there are two basic type of facial tissue cartons: the reach-in type and the pull-up type. The reach-in type has an opening on the carton top that may extend down one side, large enough to reach in and retrieve a single tissue. This rather large opening exposes the tissues to the surrounding environment and possible external contamination. The pull-up type has a narrow opening on the top that may be covered by a sheet of plastic material with a slit opening.

A stack of tissues is known in the art as a "clip". The clip in a pull-up type carton is generally interfolded. Interfolding means that a tissue is folded around part of an adjacent tissue in the clip. The first tissue dispensed is pulled through the slit, causing the second tissue to be partially pulled through the slit and held there frictionally, making it accessible for the next use. This cycle is continued until all the tissues in the clip are used.

This dispensing system works fairly well in a regular size carton, providing the interfolding of the clip was correctly done, otherwise, the user will have to reach through the slit plastic material repeatedly to retrieve a tissue, rendering the holding ability of the slit plastic material less useful and causing greater exposure to possible external contamination.

Tissue cartons made with additional depth to hold more tissues and cubical shaped cartons create more problems: The larger cartons with additional depth work as well as regular size cartons until the distance between the clip and the dispensing slit is increased by removing tissues to a point where the friction of the slit will no longer hold the weight of the additional tissues created by that distance, or the interfolding friction between sheets is no longer sufficient to keep the trailing sheet from falling back into the carton. A cubical shaped carton has yet another dispensing problem: the clip of the interfolded tissues is placed in the carton in an inverted U-shape, causing friction between the lead sheet of the clip and the interior walls of the carton, which makes the tissue difficult to pull through the slit and can cause tearing of the tissue.

Many efforts have been made to alleviate the stated problems:

U.S. Pat. No. 3,942,682 to McKay (1976) and U.S. Pat. No. 5,390,820 to Wright et al (1995) utilize a flexible platform, supported by additional extensions. U.S. Pat. No. 5,979,700 to Seuss (1999) uses one or more rubber bands to bend a sheet of cardboard placed under the clip of tissues. U.S. Pat. No. 5,979,699 to Simpson (1999) uses two platforms and a styrene lifter. All these devices keep the clip pushed toward the top dispensing aperture, however, these inventions require numerous parts and assembly steps in manufacturing.

U.S. Pat. No. 2,087,181 to Conway (1937), U.S. Pat. No. 2,347,823 to Goodman et al (1944), U.S. Pat. No. 3,826,407 to Keating (1974), And U.S. Pat. No. 4,185,753 to Leto (1980) pertain to dispensing devices for cosmetic sheets in wrist bracelets. The devices of Conway and Goodman require springs to move the cosmetic sheets toward the dispensing aperture.

U.S. Pat. No. 2,237,424 to Hope (1941) and U.S. Pat. No. 5,156,570 to Windorski (1992) uses a coiled spring to lift the tissue clip. U.S. Pat. No. 2,253,742 to West et al (1941) uses two spring activated plates to raise the clip. These devices make the containers more complex and expensive.

U.S. Pat. No. 5,065,936 to King (1991) uses a collapsible box design to make the tissues remain close to the dispensing aperture by making the interior space smaller. This invention requires deliberate effort by the user to crush the four sides and four corners of the container.

U.S. Pat. No. 3,202,316 to Silver (1965), U.S. Pat. No. 3,647,114 to Bleuer (1972), U.S. Pat. No. 4,616,767 to Seido (1986) and U.S. Pat. No. 5,979,700 to Suess (1999) use elastic strips to elevate the tissue clips. These devices also make the containers more complex and expensive.

U.S. Pat. No. 4,238,068 to Ellerbe et al (1980) provides for an elevating mechanism that uses two major and two minor side panels which the user folds twice to decrease the depth of the container two levels. Additional closure flaps are required for ends of the tubular container. This invention is complex and additional procedures and expense are required.

U.S. Pat. No. 6,283,295 to Akutagawa et al (2001) provides elevating panels and bracing panels that are manipulated by the user to elevate and lock a floating panel to a raised position. This limits the invention to two positions of the clip.

BACKGROUND OF INVENTION—OBJECTS AND ADVANTAGES

Accordingly, several objects and advantages of the present invention are:

(a) to provide an attractive tissue dispenser that has a tissue easily accessible until all the tissues have been used without the expense of elevating devices or user manipulation and crushing of the container;

(b) to provide a tissue dispenser that protects the tissue clip from exposure to external contamination;

(c) to provide a tissue dispenser that doubles in size by using the bottom portion as a sanitary disposal for used tissues;

(d) to provide a tissue dispenser that promotes a safer, healthier environment by placing used tissues in a closed container;

(e) to provide a tissue dispenser that is especially handy as a combination dispenser and disposal for bedridden or immobile people;

(f) to provide a tissue container that has an ideal location for ads or re-purchase coupons at the bottom of the tissue clip;

(g) to provide a tissue dispenser that doubles as a convenient disposal container to throw away used tissues.

Further objects and advantages are to provide an expandable, combination dispenser and disposal for tissues that is inexpensive to manufacture and simple to use. More objects and advantages will become apparent from a consideration of the ensuing description and drawings.

SUMMARY OF THE INVENTION

My invention relates to a system for dispensing facial tissues through a dispensing aperture, from within a plastic bag, attached inside a carton, and disposing of the used tissues through one or more opposed disposing apertures in the same carton.

A stack of interfolded tissues is known in the art as a clip. The present invention requires placing the clip on top of rigid cardboard of approximately the same length and width as the clip and sealing both inside a flaccid plastic bag. The clip bag is then glued to the underside of the top wall of the carton around the perimeter of the dispensing aperture. The bag may be slit at the top so that tissues are dispensed through the slit. The slit is sized small enough to frictionally hold the tissues and prevent them from falling back through the slit.

The pre-scored and folded, vertical walls of the carton allow the carton to expand in a vertical direction as the user conveniently disposes of used tissues through one or more self-closing apertures in the bottom of the carton. Simultaneously, the bulk of the used tissues applies a vertical force on the floating floor of the enclosed clip, urging the clip gently against the dispensing aperture at the top of the carton.

The carton may be made with conventional material, preferably recyclable cardboard. The expandable vertical walls may be formed by scoring parallel lines, spaced equal distance apart, around the perimeter of the carton. Scoring adjacent parallel lines on opposite sides of the cardboard blank and also scoring auxiliary "V" shaped scores connecting the adjacent parallel lines at 45 degrees angles to the vertical corners will allow the carton to be folded in an "accordion fashion". The tissue-dispensing package may be sold in a collapsed form and then expanded to approximately twice the original height to allow the user to conveniently dispose of the used tissues in a sanitary method.

The self-closing apertures in the bottom of the carton may be made by perforating "H" patterns and inside scoring across the top and bottom of the vertical legs of the "H". The user may easily open the apertures by pushing on the perforate "H" and then dispose of used tissues by pushing them through the created opening. To maintain the strength of the bottom of rectangular shaped cartons, two or more smaller disposing apertures may be better than one large one. The disposing aperture is made self-closing by the swinging action of the two flaps created by scoring across the top and bottom vertical legs of the perforated "H"; the scores becoming the hinges. The; weight of the tissues within the carton causes the disposing aperture to remain closed until the user pushes in another used tissue for disposal.

The present invention has several novel advantages over conventional tissue dispensing cartons. First, the problem of tissues failing back into the carton when the level of tissues gets low is eliminated without the expense of devices, springs or elastic bands. Second, having a disposal at hand when using the tissues is very convenient and allows for a more sanitary and cleaner environment. Third, the top of the floating floor in the clip will seal off the dispensing aperture and become visible when the last tissue is removed, creating and ideal spot for attachment of repeat purchase coupons. Fourth, the disposal of recycling of the carton with compacted contents is neat and easy.

Any specifications on the above description should not be construed as limitations of the invention. Many shapes of cartons, including cylindrical, may be made expandable and used to dispense and dispose of a variety of folded or stacked paper or other flexible material.

DRAWINGS—FIGURES

In the drawings, like numerals of reference refer to like parts in both views.

Figure 2:
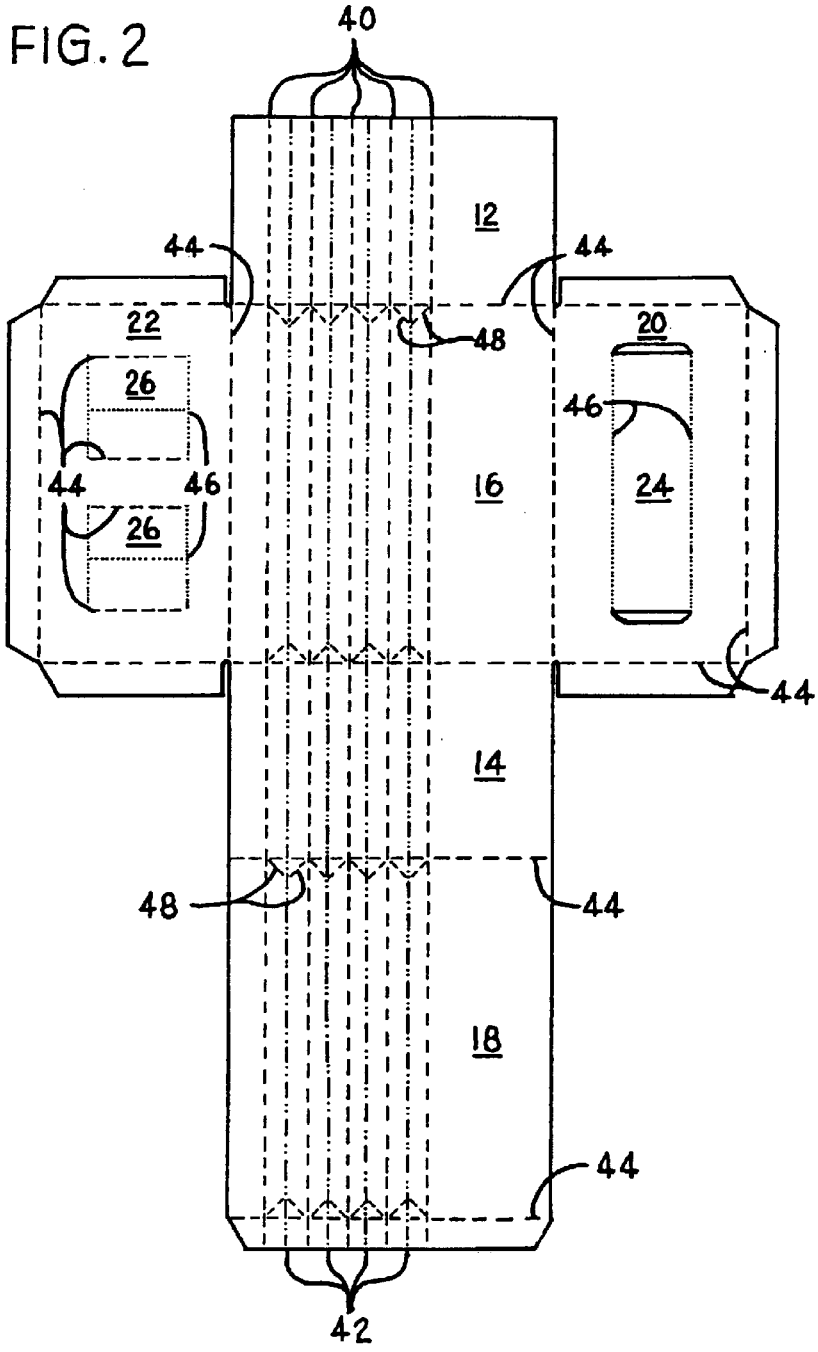

FIG. 1 is a perspective view of a tissue dispensing carton incorporating the principles of the present invention and FIG. 2 is a plan view of a flat cardboard blank from which the carton may be made, with the visible surface being the inside of the finished carton.

DETAILED DESCRIPTION—FIG. 1 AND FIG. 2—PREFERRED EMBODIMENT

Referring now to the drawings, the illustrated EXPANDABLE, COMBINATION TISSUE DISPENSING AND DISPOSING SYSTEM may be seen to comprise a carton 10, having a stack of interfolded tissues 28 within. A stack of interfolded tissues 28 is known in the art as a clip 28. The present invention requires placing the clip 28 on top of a rigid cardboard 32 of approximately the same length and width as the clip 28 and sealing both inside a flaccid plastic bag 30. The clip bag 30 is then glued to the underside of top wall 20 of the carton 10 around the perimeter of the dispensing aperture 24. The clip bag 30 may be slit at the top so that tissues 28 are dispensed through the slit 36. The slit 36 is sized small enough to frictionally hold the tissues 28 and prevent them from falling back through the slit 36.

The pre-scored 40,42 and folded, vertical walls 12,14,16, 18 of the carton 10 allow the carton 10 to expand in a vertical direction as the user conveniently disposes of used tissues 34 through one or more self-closing apertures 26 in the bottom 22 of the carton 10. Simultaneously, the bulk of the used tissues 34 applies a vertical force on the floating floor 32 of the enclosed clip 28, urging the clip 28 gently against the dispensing aperture 24 at the top of the carton 10.

The carton 10 may be made with conventional material, preferably recyclable cardboard.

The expandable vertical walls 12,14,16,18 may be formed by scoring parallel lines 40 on the inside and parallel lines 42 on the outside, spaced equal distances apart, around the perimeter of the carton 10. Scoring adjacent parallel lines on opposite sides of the cardboard blank and also scoring auxiliary "V" shaped scores 48 connecting the adjacent parallel lines 40,42, at 45 degree angles to the vertical corners as shown will allow the carton 10 to be folded in an "accordion fashion". The tissue-dispensing carton 10 may be sold in a collapsed form and then expanded to approximately twice the original height while the user conveniently disposes of the used tissues 34 in a sanitary method.

The self-closing aperture 26 in the bottom 22 of the carton 10 may be made by perforating "H" patterns 46 and inside scoring 44 across the top and bottom of the vertical legs of the "H". The user may easily open the disposing apertures 26 by pushing on the perforated "H" and then dispose of used tissues 34 by pushing them through the created opening 26. To maintain the strength of the bottom of 22 of rectangular shaped cartons, two or more smaller disposing apertures 26 may be better than one large one. The disposing aperture 26 is made self-closing by the swinging action of the two flaps created by scoring across the top and bottom vertical legs of perforated "H": the scores becoming the hinges. The weight of the tissues 28,34 within the carton 10 causes the disposing aperture 26 to remain closed until the user pushes in another used tissue 34 for disposal.

When the user dispenses the last new tissue 28 through the slit 36 in the flaccid plastic bag 30, the floating floor 32 will seal the opening of the dispensing aperture 24, making the expanded carton ready for convenient, sanitary disposal.

I claim:

1. A facial tissue dispensing and disposing system including a floating clip bag with floor comprising:

a rectangular carton, including top, bottom, end and side walls, a stack of interfolded tissue sheets disposed within said carton, said top wall having an opening for dispensing said tissue sheets, said side walls having equally spaced horizontal scores alternately on the inside and outside around the perimeter of said end and side walls, then collapsed in accordion fashion, said bottom wall having perforated H patterns for disposing apertures, wherein, as said tissue sheets are dispensed from said clip bag through said opening in said top wall of said carton and used tissues are pushed through the said disposing apertures in said bottom wall, the said end and side walls are expanded by the volume of said used tissues, which also urge up the said floor of the said floating clip bag which positions the top sheet of said tissue sheets at the said opening for dispensing.

2. The facial tissue dispensing and disposing system including a floating clip bag with floor of claim 1 wherein the said bag is made of flaccid plastic.

3. The facial tissue dispensing and disposing system including a floating clip bag with floor of claim 1 wherein the said floor is made of cardboard material.

4. The facial tissue dispensing and disposing system including a floating clip bag with floor of claim 3 wherein an ad or coupon may be attached to upper side of said floor.

5. A facial tissue dispensing and disposing system including a floating clip bag with floor comprising:

a carton comprising at least a pair of opposite walls, with two of said walls having an opening, a carton comprising a cylindrical side wall having a stack of interfolded tissue sheets disposed within said carton, said top wall having an opening for dispensing said tissue sheets, said bottom wall having perforated H patterns for disposing apertures, a carton having a cylindrical side wall having equally spaced horizontal scores alternately on the inside and outside around the perimeter of said wall, then collapsed in accordion fashion, wherein, as said tissue sheets are dispensed from said clip bag through said opening in said top wall of said carton and used tissues are pushed through the said floor of the said floating clip bag which positions the top sheet of said tissue sheets at the said opening for dispensing.

* * * * *